US006063450A

United States Patent [19]

Bernert et al.

[11] Patent Number: 6,063,450

[45] Date of Patent: May 16, 2000

[54] METHOD AND APPARATUS FOR DIRECTLY OR INDIRECTLY APPLYING A LIQUID PASTY APPLICATION MEDIUM TO ONE OR BOTH SIDES OF A CONTINUOUS SURFACE

[75] Inventors: Richard Bernert, Giengen; Rüdiger Kurtz, Heidenheim; Martin Kustermann, Heidenheim; Bernhard Kohl, Heidenheim; Hans-Dieter Dörflinger, Heidenheim; Benjamin Mendez-Gallon, Itzelberg, all of Germany

[73] Assignee: Voith Sulzer Papiermaschinen GmbH, Heidenheim, Germany

[21] Appl. No.: 09/084,727

[22] Filed: May 26, 1998

[30] Foreign Application Priority Data

May 27, 1997 [DE] Germany ..... 197 22 159

[51] Int. Cl.[7] ..... B05D 1/04; B05D 3/12

[52] U.S. Cl. ..... 427/475; 427/479; 427/480; 427/482; 427/483; 427/485; 427/424; 427/358

[58] Field of Search ..... 427/475, 479, 427/480, 482, 483, 485, 424, 358, 359, 207.1; 118/314, 315; 162/135

[56] References Cited

U.S. PATENT DOCUMENTS

| | | |
|---|---|---|
| 2,130,241 | 9/1938 | MacLaurin . |
| 2,233,122 | 2/1941 | Burns . |
| 2,236,526 | 4/1941 | Drew . |
| 2,839,425 | 6/1958 | Jurinall . |
| 3,056,416 | 8/1962 | Yahihe et al. . |
| 3,152,918 | 10/1964 | Kraus . |
| 3,333,570 | 8/1967 | Paasche . |
| 3,885,066 | 5/1975 | Schwenniger . |
| 4,064,295 | 12/1977 | Singer . |
| 4,088,093 | 5/1978 | Pan . |
| 4,578,290 | 3/1986 | Kamon et al. . |
| 4,853,727 | 8/1989 | Ganzke et al. ..... 354/319 |

FOREIGN PATENT DOCUMENTS

| | | |
|---|---|---|
| 0 482 369 A1 | 4/1992 | European Pat. Off. . |
| 30 24 564 A1 | 2/1982 | Germany . |
| 85 20 129 U | 4/1987 | Germany . |
| 40 00 405 A1 | 7/1991 | Germany . |
| 40 13 322 A1 | 10/1991 | Germany . |
| 91 00 980 U | 7/1992 | Germany . |
| 43 37 438 A1 | 5/1995 | Germany . |
| 44 12 084 C1 | 1/1996 | Germany . |
| 195 04 652A1 | 8/1996 | Germany . |
| 295 06 334 U | 9/1996 | Germany . |
| 195 27 501A1 | 1/1997 | Germany . |
| 1 430 231 | 3/1976 | United Kingdom . |
| 2 250 935 | 6/1992 | United Kingdom . |

OTHER PUBLICATIONS

English Abstract of Japanese Patent Document No. JP 60–68080 A, Apr. 18, 1985.

English Abstract of Japanese Patent Document No. JP 08150367 A, Nov. 6, 1996.

English Abstract of Japanese Patent Document No. JP 4–150965 A, May 25, 1992.

*Primary Examiner*—Fred J. Parker

*Attorney, Agent, or Firm*—Taylor & Aust, P.C.

[57] ABSTRACT

The invention relates to a method for directly or indirectly applying a liquid or pasty application medium (2) onto one or both sides of a continuous surface (4), wherein the application medium (2) is applied to the surface (4) in a plurality of single application regions by means of a plurality of single application nozzles (12) spaced apart from one another side by side and/or in succession in the direction of width (B) and/or longitudinal direction of the surface (4) and clearly distanced (D) from the surface (4), the application medium (2) emerging from each of these nozzles, wherein adjacent single application regions each intersect (U) at least in part in their respective edge regions, causing a layer of application medium to be produced across substantially the entire width (B) of the surface (4) to be coated. The invention also relates to an apparatus for performing this method.

23 Claims, 5 Drawing Sheets

METHOD AND APPARATUS FOR DIRECTLY OR INDIRECTLY APPLYING A LIQUID PASTY APPLICATION MEDIUM TO ONE OR BOTH SIDES OF A CONTINUOUS SURFACE

BACKGROUND OF THE INVENTION

A method and apparatus for directly or indirectly applying a liquid or pasty application medium to one or both sides of a continuous surface.

The present invention relates to a method and apparatus for directly or indirectly applying a liquid or pasty application medium to one or both sides of a continuous surface.

Methods according to the class and apparatus according to the class are usually used as part of paper-making machines or coating plants in order to provide a continuous surface, for instance a material web composed e.g. of paper, cardboard or a textile material, with one or more layers of application medium, e.g. dye, starch, impregnating fluid or the like, on one or both sides. So-called direct application involves the application of liquid or pasty application medium from an applicator directly onto the surface of the continuous material web which during application is supported on a revolving support surface, e.g. a continuous belt or a counter-roll. Indirect application of the medium, on the other hand, first involves the application of liquid or pasty application medium onto an opposite surface which acts as a carrier face, e.g. the surface of a counter-roll designed as an application roll from where it is transferred in a roll gap, through which the material web passes, from the application roll onto the material web.

To perform the direct or indirect application techniques described above, use is normally made of application devices which either have an application chamber or are fitted with a single nozzle or free-jet nozzle extending in the form of a narrow, long gap across substantially the entire web width. A method and an apparatus used to apply a single trace—which is as far as possible narrow—of liquid or pasty medium, preferably glue, onto a continuous material web are known from DE 195 04 652 A1. For this purpose, the apparatus has a nozzle head with a single nozzle from which the medium is sprayed directly and without contact onto a narrow partial region of the material web.

A method, comparable with the technical solution according to DE 195 04 652 A1, and its associated apparatus are also known from DE 295 06 334 U1. The method according to DE 295 06 334 U1 also involves the application of just one strip-like trace of application medium.

SUMMARY OF THE INVENTION

The present invention is based upon the object of providing an innovative, simple and effective method of directly or indirectly applying a liquid or pasty application medium onto one or both sides of a continuous surface essentially over the entire surface area. Another object is to make available a suitable apparatus for performing this method.

According to this method of directly or indirectly applying a liquid or pasty application medium onto one or both sides of a continuous surface, the application medium is applied onto the surface in a plurality of single application regions by means of a plurality of single application nozzles spaced apart from one another side by side and/or in succession in the direction of width and/or longitudinal direction of the surface and clearly distanced from the surface; the application medium emerges from each of these nozzles, whereby adjacent single application regions respectively intersect in their respective edge regions at least to an extent, thus producing a layer of application medium across essentially the entire width of the surface to be coated.

In accordance with the invention, the continuous surface may be a material web, particularly one made of paper or cardboard, (e.g. in the case of direction application) or it may also be the surface of an application roll (e.g. in the indirect technique) or another revolving support or carrier face. The application medium is applied without contact from the respective single application nozzles onto the continuous surface, i.e. there is no direct contact between the nozzles and the surface. In the method according to the invention, the single application nozzles form a nozzle array which extends substantially in the direction of width of the continuous surface or at an angle thereto. The nozzles can be evenly or unevenly arranged in a row and can also be staggered in relation to the continuous surface's longitudinal direction. In this way, arrays with curved sections, such as a wavelike array etc., are possible in addition to a straight array. In a specific configurational pattern, the single application nozzles can also be distributed across substantially the entire width of the continuous surface to be coated, whereby apparent overlaps of individual sections of the course of the array are also possible. As compared with the known prior art, the entire application covering substantially the entire surface area is therefore made up—in the method according to the invention—of a plurality of small single application regions which are primarily obtained from the ejection geometry and ejection characteristic of the respective single application nozzles. A number of nozzle types is in principle conceivable as suitable application nozzles. The following are feasible examples: nozzles which generate a free jet, i.e. a "continuous curtain"—running through the ambient atmosphere—of the ejected application medium, spray nozzles which atomize the application medium, including sprayers with electrostatic and/or mechanical atomizers, e.g. high-rotation bell-type spray systems, and the like.

The respective edge regions of the coated surface's adjacent single application regions can be intersected either in that the application medium ejected by two adjacent single application nozzles respectively in a single operating cycle is intersected before or during application onto the surface, i.e. by overlapping the spray cones or jets of these nozzles, or in that single application regions only overlap in consecutive operating cycles, e.g. by two successive and "staggered" nozzle arrays.

The intersection or overlapping of the respective edge regions of the single application regions produced by the single application nozzles is preferably adapted to one another with such precision that an even layer thickness is obtained over substantially the entire width of the coated continuous surface. This is not, however, absolutely necessary. Particularly in the case of indirect application, it is possible for the application produced by the single application nozzles initially to be still somewhat striped and for it not to be evened out until afterward in the subsequent roll gap or by using metering and/or evening-out means downstream of the nozzles.

The method according to the invention can be performed using particularly simple and inexpensive structural design means, making it possible to produce an even and top-quality application over the entire surface area in a simple and effective manner both in a direct and in an indirect application process. Since the entire application is, as explained above, composed of a number of small single application regions formed by the single application nozzles, not only a longitudinal profile but also a transverse profile of the application that is generated or is to be generated can—if necessary—in a way be set, manipulated or at least pre-regulated to a considerable extent in a common procedural step. Since the single application nozzles can also in principle be individually controlled, an effective control and/or regulating concept can be implemented in a particularly simple way in the method according to the invention.

The application medium is preferably applied to the surface essentially without excess; for this purpose, only as much application medium is ejected from the single application nozzles as is needed to build up the predetermined layer thickness.

As concerns specific applications, however, it has also proved advantageous to apply an excess of application medium according to another possible embodiment version of the invention, with the amount of application medium preferably corresponding to 2 to 5 times the final application to be achieved. The invention is not, however, exclusively restricted to the aforementioned quantitative data. If necessary, it is by all means possible to exceed or fall short of these values. In each case, it is also optionally provided that the application medium applied in excess should be doctored by at least one doctor element and returned to an application-medium loop. As already briefly indicated earlier on, it is also provided, as part of the above invention according to at least another embodiment, that the application medium applied to the continuous surface should be evened out by at least one evening-out means. In practice, doctor elements such as doctor blades, doctor bars, roller doctor elements or the like are used as evening-out means and/or to doctor any excess application medium. If a doctor bar, particularly a smooth doctor bar, is used, it is expedient for this bar to have as large a diameter as possible. For the purpose of effectively doctoring, evening out, and setting a specific coating weight or a specific coating thickness, such a doctor element does in fact require a correspondingly high dynamic pressure to float on the surface. This pressure has to be generated by the kinetic energy and impulse of the liquid or pasty application medium coating film previously applied by the single application nozzles to an application roll (in the case of indirect application). The coating film's low mass in the case of application by means of the single application nozzles makes it necessary for the area below the doctor bar to be large, particularly so as to ensure that the doctor bar floats and hence to ensure systematic doctoring even in the case of low machine speeds or low advancing speeds of the continuous surface and in the case of a low film impulse. Instead of the smooth doctor bar, doctor bars with a grooved or rough surface can also be used in principle. The smooth doctor bar is nevertheless recommended for improved floating characteristics. If possible, the doctor bar's diameter should be at least 14 mm, though preferably approx. 35 mm. The invention is not, however, restricted to these dimensions. Depending on the particular application, it is by all means possible to exceed or fall short of the above values.

The aforementioned object is also solved by an apparatus according to the invention comprising the features of claim 14. This apparatus for directly or indirectly applying a liquid or pasty application medium onto one or both sides of a continuous surface comprises a plurality of single application nozzles spaced apart from one another side by side and/or in succession relative to the direction of width and/or longitudinal direction of the surface; the application medium emerges from each of these nozzles which are clearly distanced from the surface. The apparatus according to the invention also provides those advantages already discussed in conjunction with the method according to the invention. The apparatus according to the invention can also be implemented in a particularly simple and inexpensive manner in terms of structural design; it has a very sturdy structure and can be handled and serviced more easily due to its simpler structure.

BRIEF DESCRIPTION OF THE DRAWINGS

The invention's preferred exemplary embodiments including additional design details and further advantages are more closely described and explained as follows with reference to the attached drawings.

To avoid repetitions, identical parts and components will also be identified by the same reference symbols in the following description and Figures, unless it is necessary to draw further distinctions.

DETAILED DESCRIPTION OF THE INVENTION

Figure 1:
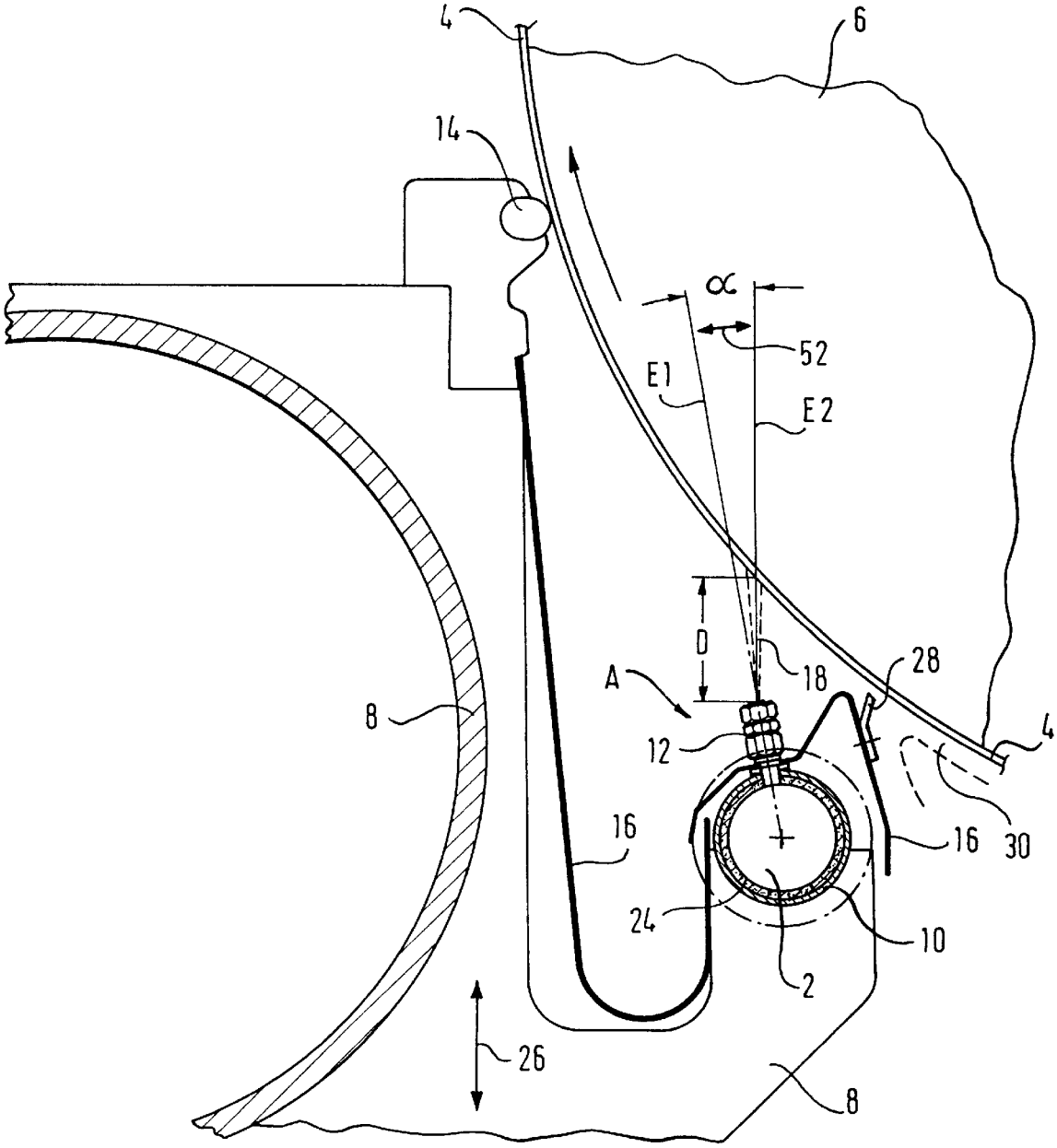
FIG. 1 shows a schematic sectional side view of an essential partial region of an apparatus according to the invention as part of a first embodiment.

As a schematic sectional side view, FIG. 1 depicts a first embodiment of an apparatus according to the invention which is designed in the present instance as an apparatus for directly applying a liquid or pasty application medium 2 to a continuous material web 4. The apparatus comprises a counter-roll or supporting roll 6 over which the material web 4 passes. The direction of rotation of the supporting roll 6 and hence the direction of movement of the material web 4 is indicated by an arrow. The apparatus also comprises a support beam 8 which faces the supporting roll 6 and at which an application means A is held. The application means A is fitted with a distributing pipe 10 that supplies the application medium 2 and at which there is provided a plurality of single application nozzles 12 spaced apart from one another side by side relative to the direction of width (cf. reference symbol B in FIG. 2) of the material web 4; these nozzles extend here in a straight line in an evenly distributed manner across the entire material web width. The distributing pipe 10 which communicates with the single application nozzles 12 is provided with a nonstick coating 24 or is at least to an extent made of a material exhibiting nonstick properties, e.g. PTFE (TEFLON) or carbon fiber plastic. The application medium 2 supplied to the single application nozzles 12 therefore cannot adhere to the distributing pipe 10 and no particular cleaning measures are necessary, which is also particularly advantageous when changing over to another type of application medium.

As can be clearly identified in FIG. 1 and indicated by reference symbol D, the respective single application nozzles 12 are clearly distanced from the surface of the material web 4 to be coated. The distance D of the single application nozzles 12 from the surface of the material web 4 is adjustable in the present example. This happens by correspondingly varying the height of the support beam 8 which supports the distributing pipe 10 and the nozzles 12; such a variation of the height is to be effected manually and/or automatically and is optionally brought about by a combined movement. This adjustment movement is indicated by a dual arrow 26. Instead of the support beam 8, however, other suitable apparatus components correspondingly designed for this purpose, e.g. a modified distributing pipe 10, can, in principle, also be moved. In FIG. 1, the emerging angle of a nozzle jet 18 that emerges from a particular single application nozzle 12 is marked by the reference symbol $\alpha$. This angle measured between a first reference plane E1 (placed through the single application nozzle 12 and also running through the center of the distributing pipe 10) and a second reference plane E2 (placed through the center axis of the nozzle jet 18) should preferably be less than or equal to 30°. The emerging angle $\alpha$ can also, of course, assume the value 0. According to the invention, all the nozzles 12 can have the same or different emerging angles $\alpha$. In this particular exemplary embodiment, the angle $\alpha$ of the single application nozzles 12 is adjustable, as indicated in the Figure by the dual arrow 52.

Relative to the direction of rotation of the supporting roll 6, a doctor and evening-out means 14 is downstream of the application means A. In this example, a smooth roller doctor bar with a large diameter of approx. 35 mm acts as the aforementioned means 14. The distributing pipe 10 and the apparatus region between the application means A and the doctor means 14 are cased in cover and collecting plates 16. According to the depiction in FIG. 1, an air boundary layer removal means 28 designed in the form of a scraper is upstream of the single application nozzles 12 relative to the rotating direction of the material web 4. This means 28 removes an air boundary layer 30 entrained by the continuous surface 4 immediately before the actual application site, thus contributing toward optimizing the application result. Suitable suction or blowing means can, however, also be used instead of a scraper.

Figure 2:
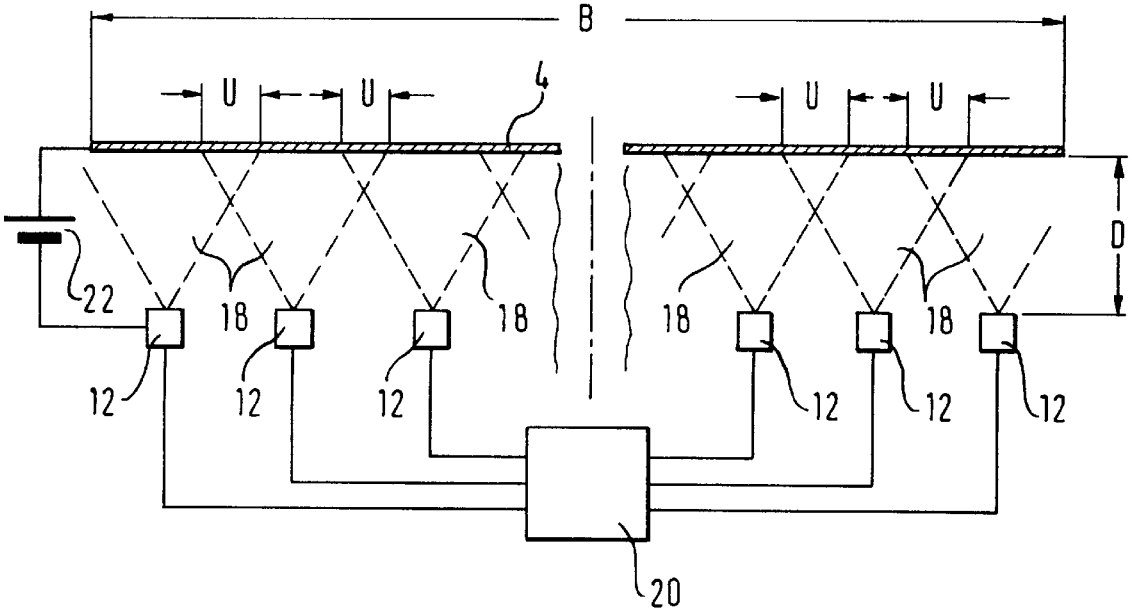
FIG. 2 shows a schematic frontal view of the arrangement of the single application nozzles of the apparatus according to FIG. 1.

The arrangement of the single application nozzles 12 relative to the direction of width B of the material web 4 and the ejection characteristic, i.e. here the spray characteristic of the nozzles 12, can be gathered from the schematic frontal view shown in FIG. 2. As can be identified in the drawing, the application medium emerges from the respective single application nozzles in the form of a nozzle jet or free jet 18 that extends in a wedge or fan shape and runs through the ambient atmosphere; this application medium is sprayed onto the material web 4 where it forms a single application region belonging to the particular nozzle. The respectively adjacent free jets 18 and hence the generated single application regions in their respective edge regions intersect (U) or overlap to an extent, thus producing on the material web 4 a layer of application medium of an essentially identical layer thickness across the entire width B of the continuous material web 4. In the present example, each of the single application nozzles 12 can be individually controlled via a control and/or regulating means 20 and as a result the spray characteristic of the nozzles 12 and/or the amount of sprayed application medium can be manipulated so as to pre-adjust a required transverse and/or longitudinal profile of the layer of application medium. In the present case, the application medium is applied in excess and the final longitudinal and/or transverse profile is set via the downstream doctor means 14 which is nevertheless not absolutely necessary. As part of the invention, however, it is also provided that the application medium should, in an alternative procedural step, be applied essentially without excess to the surface to be coated and that for this purpose only as much application medium should be ejected or sprayed from the single application nozzles 12 as is needed to build up a predetermined layer thickness.

The apparatus is also fitted with an electrostatic charge means 22 which electrostatically charges the continuous material web 4 while the application medium 2 is being sprayed on and which consequently ensures a particularly even and effective application. For the sake of clarity, the charge means 22 is only marked in the drawing between the material web 4 and one of the plurality of single application nozzles 12. A suitable potential does, however, expediently exist between all the nozzles 12 and the material web 4.

Figure 3:
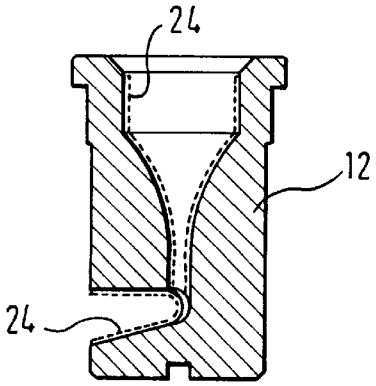
FIG. 3 shows a schematic sectional view of a single application nozzle of the apparatus of FIG. 1.

FIG. 3 shows a schematic sectional view of a single application nozzle 12 of the apparatus according to FIGS. 1 or 2. In the present exemplary embodiment, tongue-type nozzles, which are known per se, are used as application nozzles; they generate a broadly fanned, narrow flat jet (free jet) with a clearly delimited spray image and have proved to be resistant to clogging up and to be easy to service, particularly in the case of pasty application media. The invention is not, however, exclusively limited to this type of nozzle. Other suitable nozzles, e.g. so-called flat-jet nozzles or nozzles with a circular spray pattern, as well as electrostatic or mechanical atomization high-rotation bell-type spray devices (with externally mounted ionization electrodes too), can equally be used, as can combinations of the various nozzle types. If mechanical atomization high-rotation bell-type spray devices are used, the application medium is atomized purely mechanically and then electrostatically supplied to the surface to be coated by means of a guide air current which is also used to regulate the width and homogeneity of the spray jet. The air for the guide jet can for example flow, in an annular fashion, out of air bores disposed behind the high-rotation bell and guides the droplets of application medium together with the electrostatic field forces to the surface to be coated. For certain applications, the single application nozzles can also be fitted with an air admixing means. It is also apparent from FIG. 3 that the single application nozzle 12 is provided with a nonstick coating 24 so that the application medium does not adhere to the nozzle 12, but drains off from it. No special cleaning measures are therefore necessary for this single application nozzle 12, which is also of enormous benefit particularly when switching over to a different type of application medium.

Figure 4:
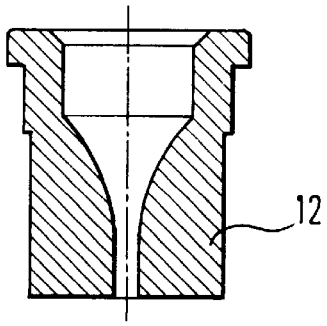
FIG. 4 shows a schematic sectional view of another type of single application nozzle to be used in an apparatus according to the invention.

Similar to the manner of depiction adopted in FIG. 3, FIG. 4 shows a schematic sectional view of another type of single application nozzle 12 to be used in an apparatus according to the invention. This nozzle is also a flat-jet nozzle, but it produces a straight, fanned-out flat jet running substantially parallel to the longitudinal nozzle axis indicated by a dot-dashed line.

Figure 5:
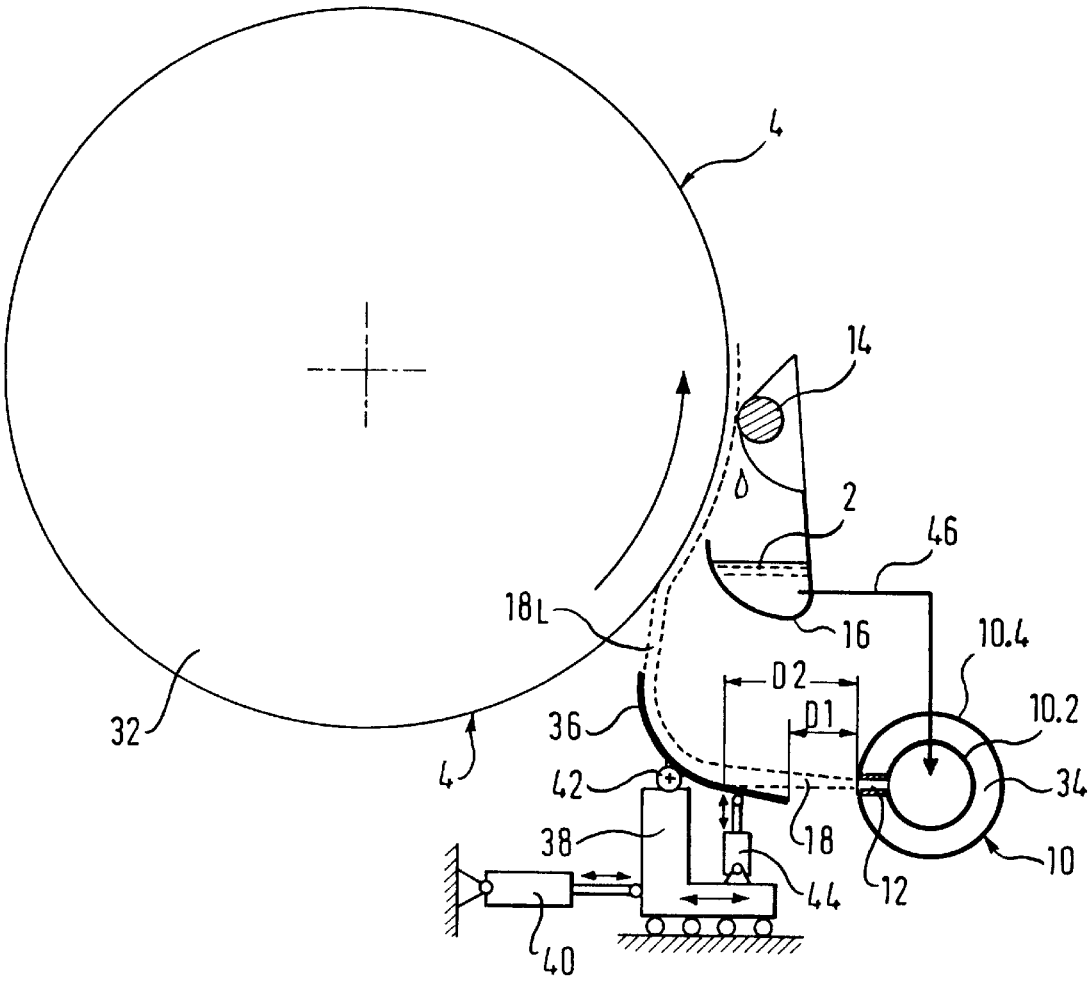
FIG. 5 shows a schematic sectional side view of an essential partial region of an apparatus according to the invention as part of a second embodiment.

Similar to the manner of depiction adopted in FIG. 1, FIG. 5 shows a schematic, considerably simplified sectional side view of an essential partial region of an apparatus according to the invention as part of a second embodiment. This version is designed as an apparatus for indirectly applying a liquid or pasty application medium 2 to an application roll 32, with the periphery of the rotating application roll 32 forming the continuous surface 4 to which application medium 2 is applied by the single application nozzles 12. The coating of the material web itself then occurs in a roll gap through which the material web passes and in which the application medium 2 is transferred from the roll surface 4 (which acts as a carrier face) to the material web. For the sake of clarity, the material web, roll gap and their arrangement are not portrayed in the drawing and may be assumed to be known as such. The distributing pipe 10 is produced in this example as a dual-wall component made of a material exhibiting nonstick properties, namely a composite carbon fiber material, with an inner pipe 10.2 forming the supply duct for the application medium 2 and with an outer pipe casing 10.4 forming a duct for cooling water 34. The single application nozzles 12 are designed as narrow, slot-like emitting ducts which pass through the body of the distributing pipe 10 and comprise an essentially rectangular cross-sectional passage area; they act as flat-jet nozzles which produce a thin, fanned flat jet 18 of the application medium 2.

It can also be inferred from FIG. 5 that a nozzle jet deflection means 36 is provided between the flat-jet nozzles 12 and the continuous surface 4 and deflects the respective nozzle jet 18 of the application medium 2 emerging from a particular flat-jet nozzle 12 toward the continuous surface 4. In the exemplary embodiment according to FIG. 5, a common nozzle jet deflection means that extends substantially across the entire width of the application roll 32 is assigned to all the flat-jet nozzles 12. The nozzle jet deflection means is designed as a concavely curved impact plate 36. For certain applications, the impact plate 36 can also, of course, have another suitable shape. In particular, the impact plate 36 can be designed to be planar or concavely or convexly curved. It is also evident from the drawing that the impact plate 36 is spaced apart from the flat-jet nozzles 12 by a distance D1. In other words, the nozzle jet 18 that leaves the outlet opening of a particular flat-jet nozzle 12 first goes a certain distance through the free ambient atmosphere before it encounters the impact plate 36. The distance between the nozzle outlet opening and the impact region on the impact plate 36 is marked by the reference symbol D2. The nozzle jet 18 is deflected on the impact plate 36 toward the continuous surface 4 and leaves the impact plate 36 at its upper free end again so as to move subsequently over another partial distance through the free ambient atmosphere toward the surface 4 to be coated. The nozzle jet which leaves the impact plate 36 and which has special properties—as will be explained in even greater detail as follows—is identified here by the reference symbol $\mathbf{18}_L$. A distance of about 3 to 20 mm, though preferably about 4–7 mm, has proved successful as a suitable gap from nozzles 12 and impact plate 36. It is, however, explicitly pointed out that the invention is not restricted to the aforementioned values. Depending on the actual application and type of single application nozzles used and the particular nozzle jet deflection means, a modification according to the invention may by all means diverge considerably from these data.

In the version depicted in FIG. 5, the distance is adjustable to a varying degree rather than to a predefined extent. This is achieved in that the arrangement of the nozzle jet deflection means 36, i.e. the impact plate 36, is adjustable relative to the flat-jet nozzles 12. For this purpose, the impact plate 36 is secured on a mount 38 which travels within a predetermined distance range relative to the flat-jet nozzles 12. This mount 38 can be moved toward and away from the flat-jet nozzles 12 (indicated in FIG. 5 by the dual arrow) by means of a plurality of first actuators 40 spaced apart from one another in the direction of width of the application roll 32 and engaging with the mount 38. The distance of the impact plate 36—fixed on the mount 38—to the flat-jet nozzles 12 is therefore variable if need be. The impact plate 36 is also pivotably supported on the mount 38 via an axis 42 and is pivotable by means of a plurality of second actuators 44 spaced apart from one another in the direction of width of the application roll 32 and engaging with the impact plate 36 and mount 38 relative to the flat-jet nozzles 12 and the continuous surface 4. In this way, the impact angle of the flat jets 18 can be set to the impact plate 36, and the impact angle of the nozzle jet $\mathbf{18}_L$ that leaves the impact plate 36 can be set to the continuous surface 4.

Since the impact plate 36 also has a certain flexibility, not only a change in distance which is even across substantially the entire application roll width can be achieved by evenly operating all the first actuators 40, but a locally varying change in distance can also be achieved by operating just certain first actuators 40. Evenly operating all the second actuators 44 also makes it possible to change the impact angles evenly across substantially the entire application roll width, whereas operating just specific second actuators 44 brings about a locally varying change in impact angles. It is evident that it is possible in this way to manipulate not only the position of the impact plate 36 in relation to the approach-flow direction of the nozzle jets 18 but also the geometry of the nozzle jet deflection means 36 itself.

The nozzle jet deflection means according to the invention on the one hand causes the nozzle jets 18 to be evened out, i.e. it simultaneously acts here as a nozzle jet evening-out means disposed between the single application nozzles 12 and the continuous surface 4, and on the other hand it entails a certain delay or two-dimensional extension or propagation of the nozzle jets 18. It has been shown that single laminar jets or laminar flat jets $\mathbf{18}_L$ can be surprisingly produced in this way; such jets can not only be contained in a locally relatively accurate manner, but also enable a very even distribution of the application medium 2 to the continuous surface 4 as a result of the interference of the respective single jets $\mathbf{18}_L$. The approach-flow or impact angle of the nozzle jet 18 of the liquid or pasty application medium 2 on the nozzle jet deflection means determines the degree of resultant jet extension, i.e. the angle of propagation of the generated laminar flat jet $\mathbf{18}_L$.

In the exemplary embodiment according to FIG. 5, the application medium 2 is applied in excess, with the quantity of application medium 2 roughly corresponding to 2 to 5 times the final application to be achieved. The excess application medium 2 is doctored by means of a doctor element 14—here: a rotating smooth roller doctor bar with a diameter of approx. 35 mm—downstream of the application site and supplied to an application-medium loop indicated by reference numeral 46. In the present case, the roller doctor bar 14 simultaneously acts as an evening-out means which evens out the application medium 2 applied to the continuous surface 4.

Similar to the manner of portrayal adopted in FIGS. 1 and 5, FIG. Ga shows a schematic sectional side view of an essential partial region of an apparatus according to the invention as part of a third embodiment. Like the apparatus according to FIG. 5, this model also has a nozzle jet deflection means 48 disposed between the flat-jet nozzles 12 and the continuous surface 4 and again designed as a structure resembling an impact plate. The difference between it and the embodiment of FIG. 5 is primarily that this nozzle jet deflection means 48 is arranged immediately in front of the nozzle outlet openings of the flat-jet nozzles 12 and forms a guiding surface 48.2, extending from the nozzle outlet opening toward the surface 4 to be coated, for the respective nozzle jet 18 of the application medium 2 emerging from a nozzle. Here, the nozzle jet deflection means 48 therefore represents a lip-like extension of the flat-jet nozzles 12. The exact design of this particular nozzle jet deflection means 48 will be discussed in even more detail as follows.

Figure 6B:
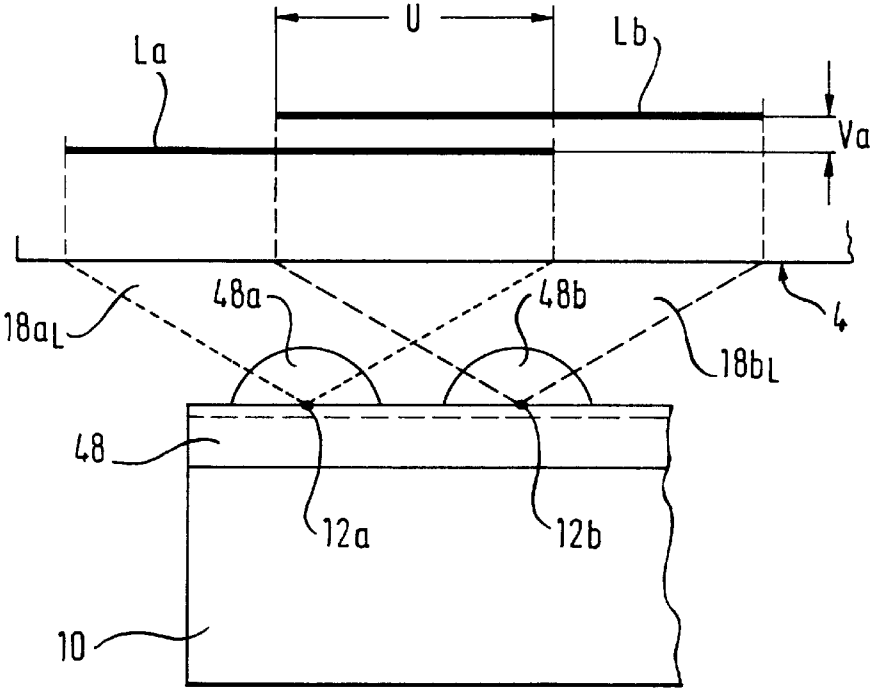
FIG. 6*b* shows a schematic top view of an essential component of the apparatus according to the invention as depicted in FIG. 6*a,* and FIG. 7 shows a schematic, considerably simplified top view of an essential partial region of an apparatus according to the invention as part of a fourth embodiment.
Figure 6A:
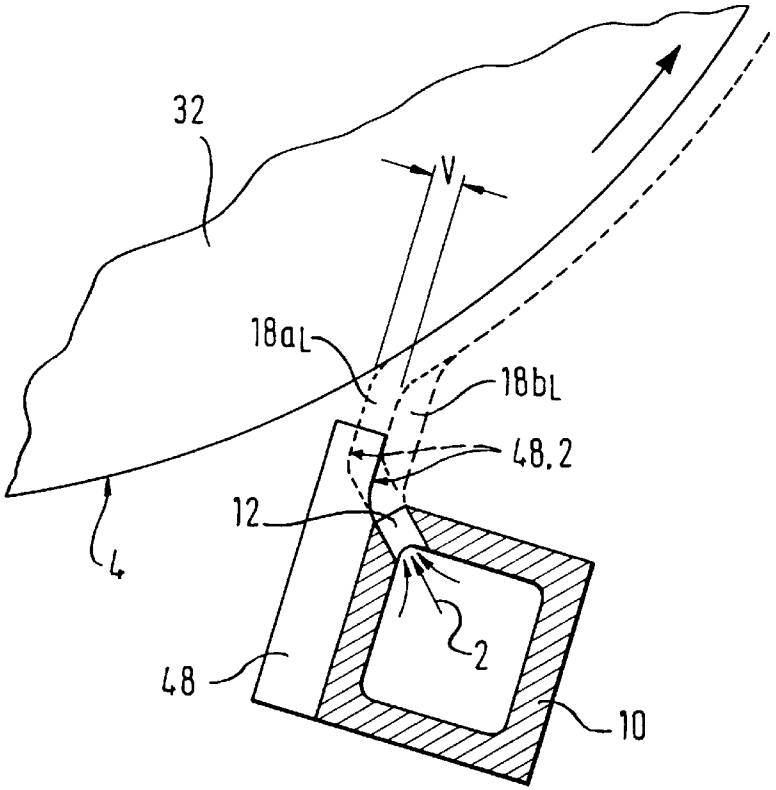
FIG. 6*a* shows a schematic sectional side view of an essential partial region of an apparatus according to the invention as part of a third embodiment.

In the present instance, the distributing pipe 10 has a rectangular cross-sectional form. Narrow and essentially rectangular (round, oval or other suitable shapes are also possible) emitting bores designed as single application nozzles 12 are provided on the line of intersection between two wall portions, at right angles to one other, of the distributing pipe 10. When interacting with the nozzle jet deflection means 48, these emitting bores largely have the properties of flat-jet nozzles, i.e. they each generate a flat, fanned nozzle jet $\mathbf{18}_L$ (see also FIG. 6*b*). As can be particularly well identified in conjunction with FIG. 6*b* which shows a schematic top view of the apparatus according to the invention as depicted in FIG. 6*a,* each single application nozzle 12 (for reasons of clarity, FIG. 6*b* shows only two adjacent nozzles which are designated by 12*a* and 12*b* for more effective differentiation) is assigned its own separate nozzle jet deflection means 48 (here: 48*a* and 48*b*). This latter device relates to an impact plate secured on the outside wall of the rectangular distributing pipe 10, but which as part of the present description is designated as impact strip 48 to distinguish it more effectively from the impact plate 36 mentioned earlier on. The impact strip 48 has a guiding surface portion 48.2 which—beneficially in terms of flow—directly adjoins the nozzle outlet opening of the single application nozzle 12. The nozzle jet 18 which leaves the outlet opening of a particular single application nozzle 12 therefore flows directly onto the guiding surface portion 48.2 of the impact strip 48, flows along this portion 48.2, is deflected toward the roll 32 and leaves the guiding surface portion 48.2 and hence the impact strip 48 (here: 48*a* and 48*b*) at its upper free end as a narrow fanned laminar flat jet $\mathbf{18}_L$. The laminar flat jet $\mathbf{18}_L$ then goes a certain distance through the free ambient atmosphere before it encounters the surface 4 of the roll 32. As indicated in FIG. 6*a* by reference symbol V, the respectively adjacent nozzle jet deflection means or impact strips 48*a* and 48*b* are staggered, so that the adjacent fanned flat jets $\mathbf{18}_L$ (henceforth designated as $\mathbf{18}a_L$ and $\mathbf{18}b_L$ by analogy with the two nozzles 12*a* and 12*b* examined here and their respective nozzle jet deflection means 48*a* and 48*b*) each starting from adjacent single application nozzles 12*a* and 12*b*—of the application medium 2 do not come into contact with one another or intersect one another on their way to the surface 4 to be coated. In the present example, the offset V is therefore expediently larger than or equal to the thickness of the respective flat jets $\mathbf{18}a_L$, $\mathbf{18}b_L$. For viewing purposes, the fanned flat jets $\mathbf{18}a_L$, $\mathbf{18}b_L$ and the partial regions of the adjacent impact strips 48*a,* 48*b* are shown in the top view according to FIG. 6*b* as being folded into the plane of observation. The impact lines La, Lb of the adjacent flat jets $\mathbf{18}a_L$, $\mathbf{18}b_L$ are also drawn into the focal plane. It is evident that the distance Va of the impact lines La, Lb, measured in the rotating direction of the surface 4 approximately corresponds to the offset V of the impact strips 48*a,* 48*b* if, as assumed here, the orientations of the impact strips 48*a,* 48*b* relative to the surface 4 and hence the spray angles observed in the lateral direction (similar to a in FIG. 1) of the flat jets $\mathbf{18}a_L$, $\mathbf{18}b_L$ relative to the surface 4 are equal. The distance Va can for example be changed by varying the aforementioned parameters, whereby Va can also be equal to 0, i.e. the flat jets $\mathbf{18}a_L$, $\mathbf{18}b_L$ intersect when they impact the surface 4 at a common impact line. The adjacent single application regions generated by such a configuration of the single application nozzles 12 and their associated nozzle jet deflection means 48*a,* 48*b* can intersect (U) at least to an extent in their respective edge regions on account of the superposition effect resulting from the progression of the continuous surface 4, so that as the continuous surface 4 advances, a closed layer of application medium can be produced across substantially the entire width of the surface 4 to be coated.

Figure 7:
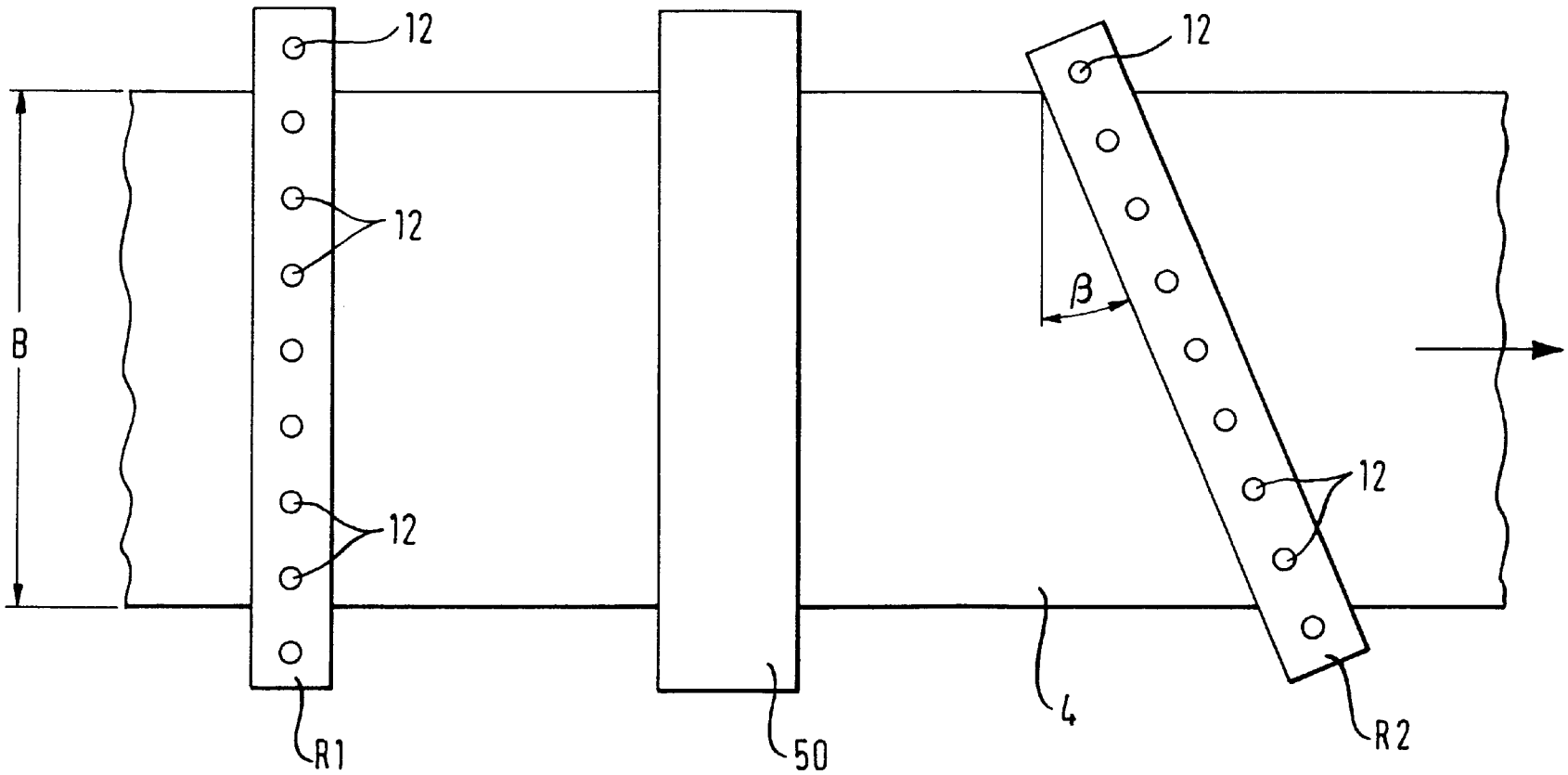

FIG. 7 shows a schematic, considerably simplified top view of an essential partial region of an apparatus according to the invention as part of a fourth embodiment. This apparatus comprises several, i.e. in the present instance two, nozzle arrays R1, R2 extending in the direction of width B of a continuous material web 4 and composed of a plurality of single application nozzles 12 (each facing the material web 4 and indicated in the Figure by circles); these nozzle arrays are spaced in the longitudinal direction of the material web 4, which corresponds to the direction of advance of the material web 4 indicated by an arrow in the drawing. The nozzle array R1 runs essentially parallel to the direction of width B, while the nozzle array R2 extends at an angle β to the direction of width B. In this exemplary embodiment, the individual amounts of application medium 2 ejected by the individual nozzle arrays R1, R2 add up, as the continuous material web 4 advances, to a necessary total application quantity. An intermediate drying means 50 which is known per se is provided between the nozzle arrays R1 and R2 in order to dry on an intermediate basis the surface region of the material web 4 already coated by the nozzle array R1 before this region reaches the following nozzle array R2.

The invention is not restricted to the above exemplary embodiments which merely serve to explain in general terms the invention's basic idea. On the contrary, the method and apparatus according to the invention can, as part of the scope of protection, also assume embodiments other than those described above. The method and apparatus may in particular comprise features which represent a combination of the respective single features of the associated claims. In particular, the apparatus can also comprise one or more doctor or cleaning doctor element means and the like upstream of the application nozzles. In at least one other preferred embodiment of the invention, it is for example envisaged that the application medium should be applied by way of two or more nozzle arrays extending in the direction of width of the surface and/or at an angle thereto and composed of the single application nozzles; these arrays are each spaced apart from one another in the longitudinal direction of the surface, whereby individual amounts of application medium ejected by the individual nozzle arrays add up, as the continuous surface advances, to a necessary total application quantity. The application can also in principle take place both without and with an excess.

It is also feasible for the single application nozzles to form two or more nozzle arrays extending in the direction of width of the surface and/or at an angle thereto; these arrays are each spaced apart from one another in the manner of a series connection in the longitudinal direction of the continuous surface, i.e. in or against its direction of movement. In this configuration, it is also possible for there to be provided between at least two successive nozzle arrays an intermediate drying means—which is known per se—for drying on an intermediate basis the surface already coated by the preceding nozzle array. In addition to the various embodiments of the nozzle jet deflection means explained above, the invention comprises such a version in which a separate nozzle jet deflection means is provided just for specific flat-jet nozzles of the total number of existing flat-jet nozzles. The length of the nozzle jet deflection means—relative to the nozzle-jet direction—may also be adjustable to a varying extent. A specific local predefinition of length of the nozzle jet deflection means can also influence its effect on the nozzle jet.

Reference symbols in the claims, description and drawings merely serve to make the invention more comprehensible and are not intended to restrict the scope of protection.

What is claimed is:

1. A method of directly or indirectly applying a liquid or pasty application medium to one or both sides of a continuous surface of a traveling fiber material web, wherein:

said application medium is applied to said surface in a plurality of single application regions by means of a plurality of single application nozzles spaced apart from one another side by side and/or in succession in the direction of width of said surface and distanced from said surface, said application medium emerging from each of said nozzles and being deflected before impacting said continuous surface to thereby even out a distribution of said application medium over said continuous surface, said application medium being deflected by a deflector disposed directly in front of a nozzle outlet opening of at least one of said single application nozzles, said deflector forming a guiding surface for said nozzle jet, said guiding surface extending from said nozzle outlet opening toward said surface to be coated, wherein adjacent single application regions respectively intersect in their respective edge regions at least in part, causing a layer of application medium to be produced over substantially the entire width of said surface to be coated.

2. A method according to claim 1, wherein said surface is electrostatically charged before spraying.

3. A method according to claim 1, wherein said surface is electrostatically charged during spraying.

4. A method according to claim 1, wherein said application medium is electrostatically charged before spraying.

5. A method according to claim 1, wherein said application medium is electrostatically charged during spraying.

6. A method according to claim 1, wherein a spray of at least one of said plurality of a single application nozzles is varied to produce a desired transverse and/or longitudinal profile of the layer of application medium.

7. A method according to claim 6, wherein a quantity of ejected application medium is varied by at least one of said plurality of single application nozzles to produce a desired transverse and/or longitudinal profile of the layer of application medium.

8. A method according to claim 1, wherein the distance of said single application nozzles is varied relative to said continuous surface.

9. A method according to claim 1, wherein said application medium is applied essentially without excess onto said surface and for this purpose only as much application medium is ejected by each of said single application nozzles as is needed to build up a predefined layer thickness.

10. A method according to claim 1, wherein said application medium is applied in excess, the quantity of application medium corresponding to 2 to 5 times the final application to be achieved.

11. A method according to claim 10, wherein said application medium applied in excess is doctored by means of at least one doctor element and returned to an application-medium loop.

12. A method according to claim 1, wherein said application medium applied to said continuous surface is evened out by at least one evening-out means.

13. A method according to claim 1, wherein said application medium is applied by a plurality of nozzle arrays extending in the direction of width of said surface and composed of said single application nozzles, said nozzle arrays each being spaced apart from one another in the longitudinal direction of said surface, wherein individual amounts of application medium ejected by said individual nozzle arrays add up, as said continuous surface advances, to a necessary total application quantity.

14. A method according to claim 13, wherein one of said individual amounts of application medium is ejected by at least one nozzle array extending at an angle to the direction of width.

15. A method according to claim 1, wherein said application medium is applied in the form of laminar flat jets onto said continuous surface.

16. A method according to claim 1, wherein an air boundary layer entrained by said continuous surface is removed relative to a direction of movement of said surface ahead of said single application nozzles.

17. A method according to claim 6, wherein said spray characteristic comprises an emerging angle at which said application medium is ejected by said at least one single application nozzle.

18. A method according to claim 1, wherein there are a plurality of adjacent deflectors which are respectively staggered in relation to one another such that adjacent nozzle jets of said application medium do not come into contact with one another or intersect on their way to said surface to be coated.

19. A method of directly or indirectly applying a liquid or pasty application medium to one or both sides of a continuous surface of a traveling fiber material web, wherein said application medium is applied to said surface in a plurality of single application regions by means of a plurality of single application nozzles spaced apart from one another side by side and/or in succession in the direction of width of said surface and distanced from said surface said application medium emerging from each of said nozzles, said respective nozzle jets of said application medium emerging from a particular single application nozzle are deflected by an impact plate before impacting said continuous surface, said impact plate being movable in two opposite directions substantially parallel to a direction of movement of said respective nozzle jets before said deflection, wherein adjacent single application regions respectively intersect in their respective edge regions at least in part, causing a layer of application medium to be produced over substantially the entire width of said surface to be coated.

20. A method according to claim 19, wherein said impact plate is pivotable about an axis substantially parallel to the width of said surface.

21. A method according to claim 19, wherein a distance between said single application nozzles and said impact plate is approximately between 3 mm and 20 mm.

22. A method according to claim 21, wherein said distance is approximately between 4 mm and 7 mm.

23. A method of directly or indirectly applying two layers of a liquid or pasty application medium to one or both sides of a continuous surface of a traveling fiber material web, wherein said application medium is applied to said surface in a plurality of first single application regions by means of a plurality of first single application nozzles spaced apart from one another side by side and/or in succession in the direction of width of said surface and distanced from said surface, said application medium emerging from each of said nozzles, wherein adjacent first single application regions respectively intersect in their respective edge regions at least in part, causing a first layer of application medium to be produced over substantially the entire width of said surface to be coated, said application medium applied to said surface by said first single application nozzles is dried by a drying device, said drying device being disposed after said first single application nozzles relative to a direction of movement of said surface, said application medium is applied to said surface in a plurality of second single application regions by a plurality of second single application nozzles spaced apart from one another side by side and/or in succession in a direction that is nonparallel relative to the direction of width, said second single application nozzles being disposed after said drying device relative to the direction of movement of said surface, wherein adjacent second single application regions respectively intersect in their respective edge regions at least in part, causing a second layer of application medium to be produced over substantially the entire width of said surface to be coated.

* * * * *

UNITED STATES PATENT AND TRADEMARK OFFICE

CERTIFICATE OF CORRECTION

PATENT NO. : 6,063,450

DATED : May 16, 2000

INVENTOR(S) : Richard Bernert, et al.

It is certified that error appears in the above-identified patent and that said Letters Patent is hereby corrected as shown below:

Column 1

Line 2, after LIQUID, insert --OR--.

Column 8

Line 62, delete "Ga" and substitute --6-- therefor.

Column 9

Line 22, after (see also Fig. 6b),, begin a new paragraph; and

Line 58, after $18b_L$., begin a new paragraph.

Signed and Sealed this

Third Day of April, 2001

*Attest:*

Nicholas P. Godici

NICHOLAS P. GODICI

*Attesting Officer*

*Acting Director of the United States Patent and Trademark Office*